US005089975A

United States Patent [19]

Mannion et al.

[11] Patent Number: 5,089,975

[45] Date of Patent: Feb. 18, 1992

[54] METHOD AND APPARATUS FOR CONTROLLING THE FLOW OF PROCESS FLUIDS

[75] Inventors: Gerald F. Mannion, Naperville, Ill.; James R. Mannion, Oconomowoc, Wis.

[73] Assignee: BRDG-TNDR Corporation, Ft. Lauderdale, Fla.

[21] Appl. No.: 464,346

[22] Filed: Jan. 12, 1990

[51] Int. Cl.[5] ..... G06F 3/04

[52] U.S. Cl. ..... 364/510; 165/22

[58] Field of Search ..... 364/510, 550, 557, 558; 165/22

[56] References Cited

U.S. PATENT DOCUMENTS

| | | | |
|---|---|---|---|
| 3,729,051 | 4/1973 | Mannion et al. | 165/22 |
| 3,875,995 | 4/1975 | Mannion et al. | 165/22 |
| 4,212,078 | 7/1980 | Games et al. | 165/22 |
| 4,574,283 | 3/1986 | Arakawa et al. | 165/22 |
| 4,875,623 | 11/1989 | Garris | 364/502 |
| 4,888,706 | 12/1989 | Rush et al. | 364/510 |
| 4,916,631 | 4/1990 | Crain et al. | 364/502 |

*Primary Examiner*—Parshotam S. Lall
*Assistant Examiner*—Ellis B. Ramirez
*Attorney, Agent, or Firm*—Dominik, Stein, Saccocio, Reese, Colitz & Van Der Wall

[57] ABSTRACT

A system for cooling a flow of air at a plurality of sites comprising a process water chiller subassembly, a plurality of air cooling subassemblies, a primary loop for process water extending between the process water subassembly and the plurality of air cooling subassemblies, means to effect a flow of air to be cooled across the secondary loops at the sites to be cooled, a plurality of water bridges, each coupling the primary loop with a secondary loop, each water bridge having feed and return connections coupled to the feed and return lines of the primary loop and feed and return connections coupling feed and return lines of a secondary loop, and a crossover line coupling the primary and secondary loops, a pressure responsive valve in the path of flow through the primary loop and a flow sensor for each waterbridge to determine the flow in its crossover line for controlling the pressure responsive valve, a temperature responsive valve in the crossover line for each waterbridge and a temperature responsive sensor responsive to the temperature of the process water in the secondary loop, a common controller for each waterbridge adapted to modify its valves as a function of the sensed temperature and flow, and a host computer coupling the common controllers in systems configuration for controlling the common controllers.

14 Claims, 6 Drawing Sheets

METHOD AND APPARATUS FOR CONTROLLING THE FLOW OF PROCESS FLUIDS

FIELD OF THE INVENTION

This invention relates to a method and apparatus for controlling the flow of process fluids and, more particularly, to a system for feeding process water in a controlled manner through a primary and secondary loops.

DESCRIPTION OF THE BACKGROUND ART

In the field of flow control systems, one technique for providing chilled process water to a plurality of remote sites is to use a primary flow loop from chillers to the sites where the water is to be utilized, as for air cooling, and then back to the chillers for recycling in a continuous cycle of operation. At the remote sites where the process water is to be used, secondary flow loops tap from, and return to, the primary loop, the chilled water for use in air cooling at each of the various sites. As a result, there is one primary loop in a continuous flow and a plurality of secondary loops for utilizing the water from the primary loop as needed.

In considering any one secondary loop, there will be a section of crossover line which is common with both the primary loop and the secondary loop. The apparatus coupling the primary loop with a secondary loop is a water bridge. A primary pump is used to continuously feed the water through the primary loop. A secondary loop is used to feed the water through each secondary loop but only at a given rate and only when required. Without appropriate controls, however, the system would be very inefficient, chilling and/or feeding more or less water than is needed for the intended air cooling.

In U.S. Pat. No. 3,729,051, the problem of controlling the quantity of flowing water was addressed and solved. According to that patent, a small supplemental water line is placed across the common extent of the primary and each secondary loop. The supplemental line at each secondary loop was of a significantly smaller diameter for a limited flow, merely sufficient to sense a primary flow balance between the primary loop and the flow of the secondary loop.

For optimum efficiency the flow through the primary loop should equal the flow through the total of secondary loops. If insufficient water is pumped in either loop, the intended cooling will not be effected. If excess water is pumped, unnecessary energy will be expended in moving the water. By sensing the flow along the supplemental line, verification may be made that water is flowing and that pressure exists in the supplemental line. So long as the sensed water in the supplemental line remains at the optimum predetermined flow, no change is made to the fluid flow. If, however, the sensed water varies from the predetermined flow, a signal is sent back to a first control valve in the primary loop to restrict the flow and thereby minimize the work done by the pump of the primary loop. This effects a greater efficiency.

In a subsequent improvement, as described in the U.S. Pat. No. 3,875,995, temperature is also taken into account for controlling water flow. In the event that the water in the secondary loop varies from its intended, predetermined temperature, inefficiency results. If the temperature of the water in the secondary loop is not cool enough, the intended air cooling will not be effected. If the temperature of the water in the secondary loop is too cool, excess chilling is being done at an unnecessary cost to the system and its user. As a result, a temperature control sensor is provided. So long as the sensed temperature is at a predetermined value, the chilling simply continues. If, however, the temperature deviates from the predetermined value, the difference is sensed and a signal is sent to a second control valve located in the crossover line of the water bridge to vary the quantity of chilled water provided to the secondary loop. This feature further increases the efficiency of the system.

In a third improvement to fluid control systems, as described in the copyrighted BRDG-TNDR Corporation brochure of 1988, the signals generated for temperature and pressure control are fed back from the water bridges of the air cooling subassemblies to the water chiller subassembly to vary the amount of recirculating water being fed through the chiller to thereby modify the temperature and pressure of the water in the primary loop. By keeping the water in the primary loop at a preselected temperature and pressure for a particular application further efficiencies are effected in the system.

The present invention, in its simplest terms, is on improvement over known flow control systems in that the temperature and pressure sensors are replaced with electronic sensors of a size and capability more efficient than those previously known and utilized. Their use in the lines of fluid flow, as described above, not only generate more accurate readings but have less effect on the flow. This further increases the accuracy of readings and provides greater control and efficiency in the system. In addition, each temperature sensor is removed from the site of sensing and repositioned with its controller adjacent to its controlled valve. As such, all electronic controls for each secondary loop are integrated into a common controller for greater overall efficiency. This more readily allows all the controllers for all the secondary loops to be in two-way communication with a common host computer for integration of the system generally. As such, the efficiencies effected to the system are greater than the sum of the efficiencies of the individual water bridges.

As referred to above, the prior art discloses systems for controlling the flow of process fluids. Nothing in the prior art, however, controls the flow with the accuracy and efficiency afforded by the present invention.

Therefore, it is an object of this invention to provide a method and apparatus which overcomes the aforementioned shortcomings and which is a significant contribution to the advancement of the arts.

It is a further object of this invention to integrate the flow controller and sensor of a water bridge into a single component.

It is yet a further object of this invention to allow the flow controller of a water bridge to use one of several means as its driver to allow for applications with various fluids under various operating conditions, i.e. high and low temperatures, high and low pressures, viscous and nonviscous, clean and dirty, etc.

Another object of the invention is to provide controllers/sensors with two-way communications for the purpose of talking with a host computer and data acquisition equipment to thereby allow for control reset, control limits, systems management, trending, historical data accumulation, etc.

A further object of the present invention is to poll the outputs of the water bridge controllers for the purpose of resetting the set points or control system pressures and temperatures.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiments may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference numerals refer to similar parts throughout the various drawings.

DETAILED DESCRIPTION OF THE INVENTION

Overview

Figure 1:
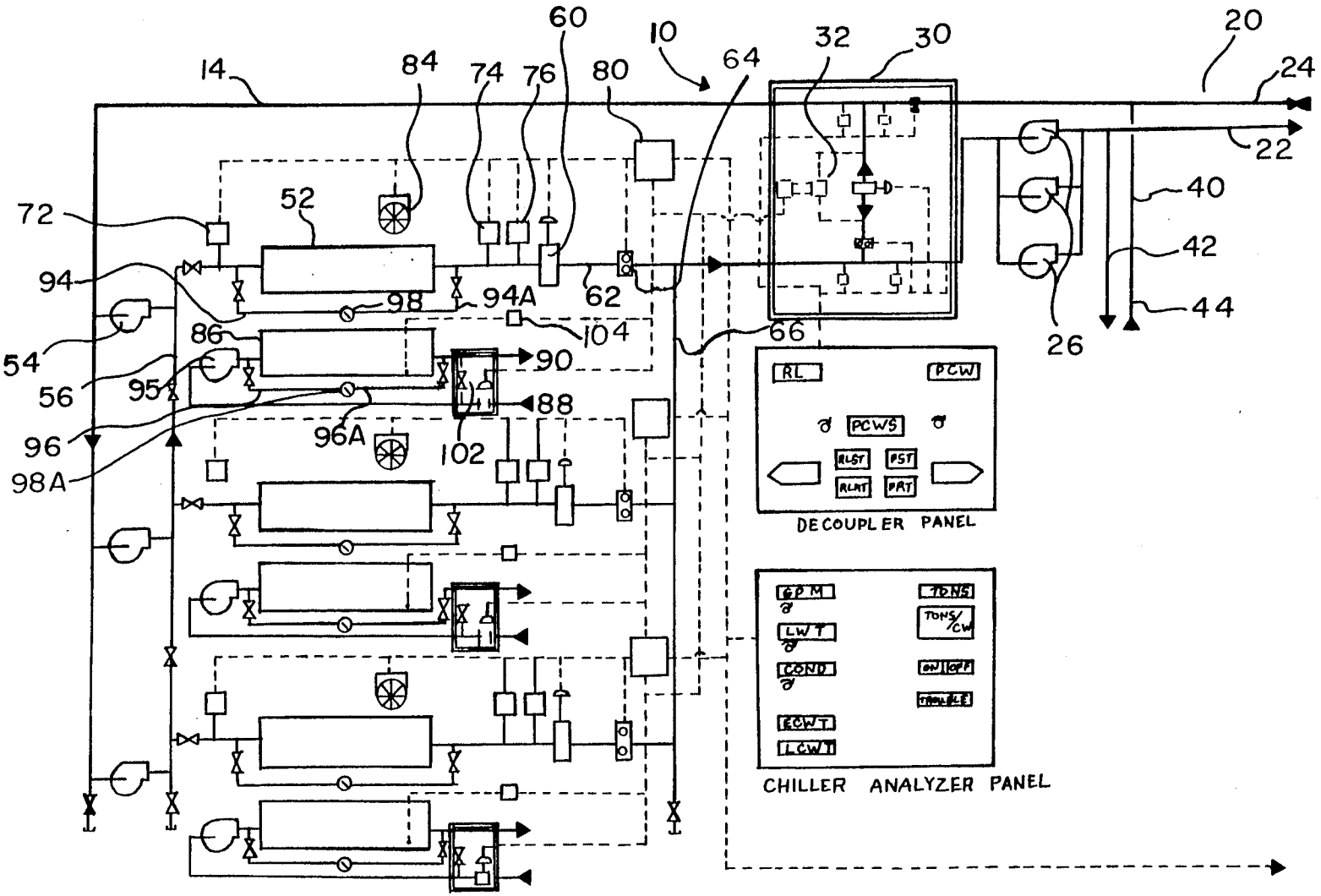
FIG. 1 and FIG. 1A together constitute a schematic illustration of a fluid control system constructed in accordance with the principles of the present invention, the water chiller subsystem being shown in FIG. 1 and the air cooler subsystem being shown in FIG. 1A.
Figure 1A:
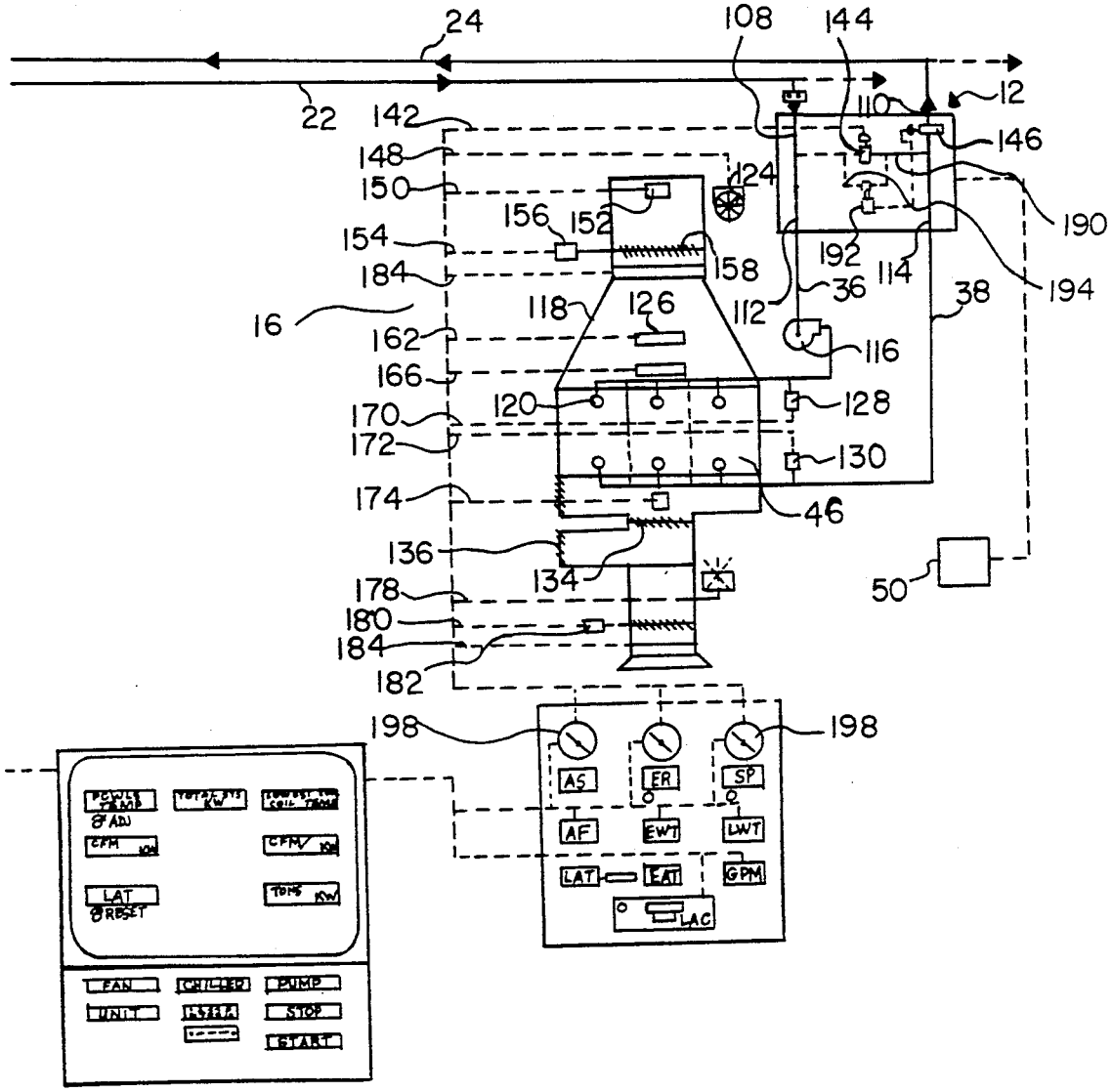

FIGS. 1 and 1A, when taken together, represent a schematic overview of a system 10 employing the water bridge 12 and control elements of the present invention. The FIG. 1 components are generally directed to the subsystem 14 for chilling the process fluid such as water to be utilized. FIG. 1A illustrates the components of the subsystem 16 wherein the chilled water is utilized as for air cooling purposes. The two subsystems are coupled by a common primary loop 20 including feed and return lines 22, 24. Also coupling the two subsystems are auxiliary feed water booster pumps 26 along with a fluid flow decoupler assembly 30 in advance of the booster pumps. Such fluid flow decoupler assembly 30 includes a water bridge 32 being of the type described in the aforementioned '051 patent.

Figure 2:
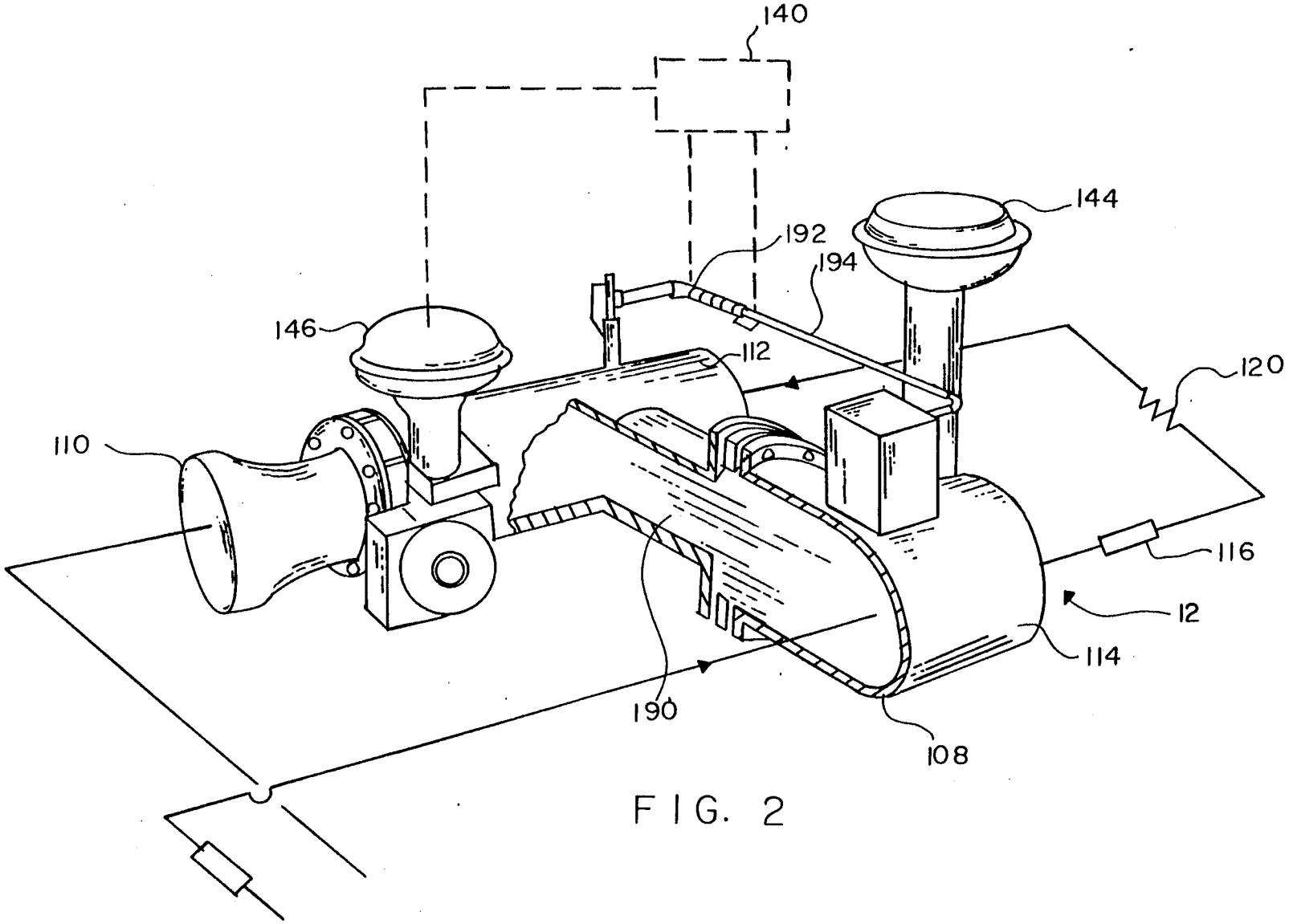
FIG. 2 is a perspective illustration of the water bridge which is shown schematically in the upper right-hand corner of FIG. 1A.
Figure 3:
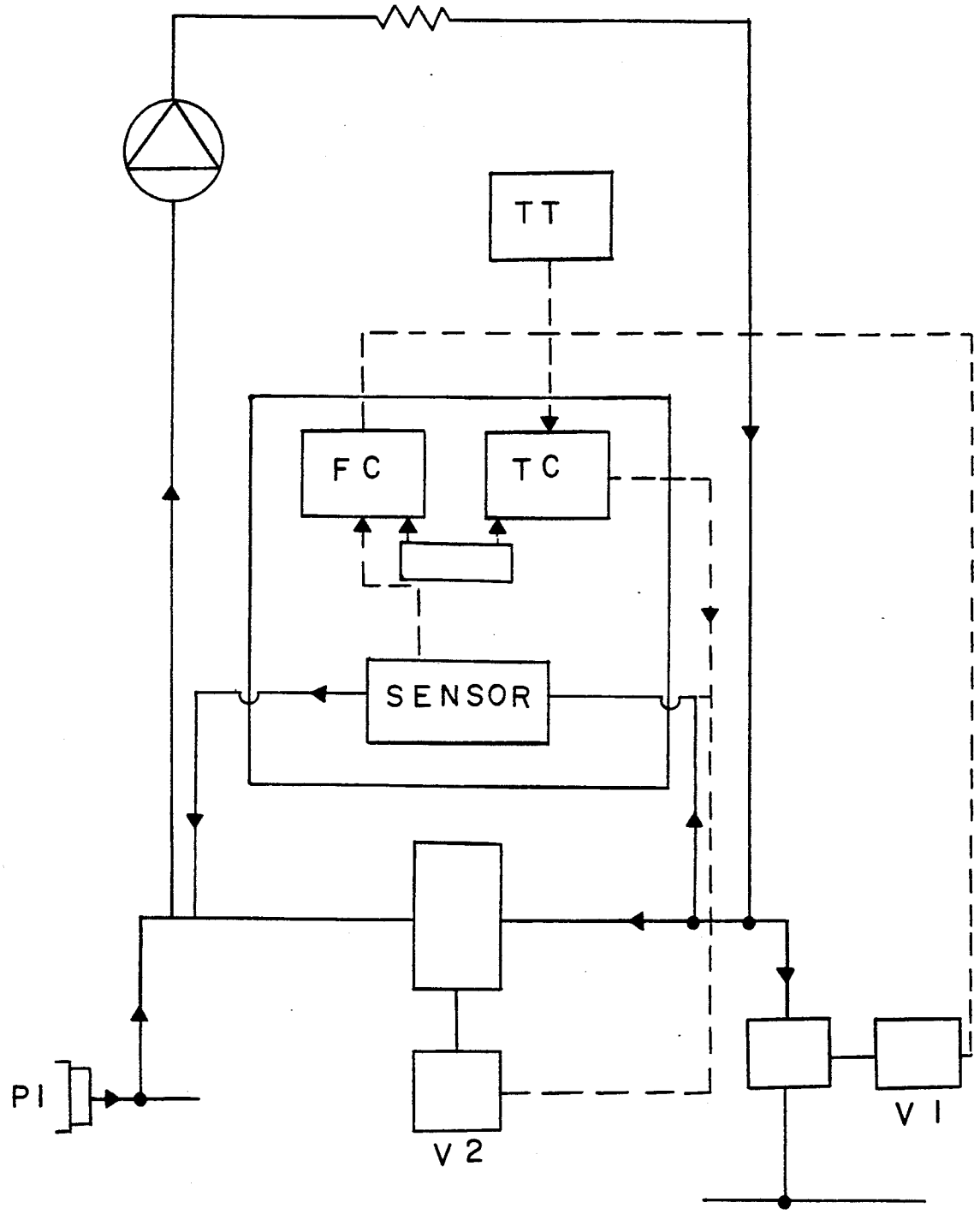
FIG. 3 is a schematic representation of the water bridge shown in FIG. 2.

FIG. 1A shows the components for utilizing the chilled process water and includes a water bridge 12 coupling the lines of the primary loop 20 with the feed and return lines 36, 38 of one illustrative secondary loop 40. The water bridge 12 is more specifically described hereinafter and can be seen in the mechanical perspective illustration and the electrical schematic of FIGS. 2 and 3. FIG. 1 also illustrates supplemental lines 42, 44 of the primary loop 20 for conveying the process water to sites other than the shown site 46 whereat it may be tapped through any number of additional water bridges for secondary loops for utilization at such additional sites other than that as shown in FIG. 1A.

Also shown in FIG. 1, as well as FIG. 1A, are a plurality of panels for monitoring and controlling the operation of the system 10. These panels include the decoupler panel, the chiller analyzer panel, the air flow control panel, the system analyzer panel, and the host computer 50.

Water Chiller Subsystem

The FIG. 1 showing illustrates in detail a typical chiller subsystem 14. Any number of individual chillers 52 might be used in the chiller subsystem. FIG. 1 illustrates three chillers, each with its own accompanying support elements. It should be understood, however, that one or any number might be used in parallel similar to the way the three such chillers are illustrated. For the sake of convenience only one chiller and its associated support elements will be described herein.

The chiller 52 has an input end to receive recirculating process water from the return line 24 of the primary loop 20. A chiller pump 54 taps a preselected quantity of process water from the return line and feed it to an intermediate input line 56 coupling the inputs of the various chillers of the subsystem. A line extends through the chiller to its output end and constitutes a separate chiller loop at the starting point of the primary loop. A flow control valve 60 is positioned in the output line 62 of the chiller. The central valve flow is followed by a flow transducer 64, a flow meter and transmitter, prior to coupling in the output of the other chillers through an output mixing line 66. Thereafter the chiller output is fed through the water bridge 32 of the decoupler assembly 30 followed by the transport or booster pumps 26. This water bridge 32 is of the type disclosed in the aforementioned '051 patent. Temperature sensors 72, 74, 76 are located to determine the chiller entering water temperature as well as the chiller leaving water temperature and feed such information to the controller 80. The output of a flow transducer 64 is also fed to the controller 80. The controller 80 acts to vary the flow control valve 60 in order to maintain the flow rate at a proper level for the intended function. The output of the controller is also fed to the chiller analyzer panel as well as the system analyzer panel for monitoring and controlling the performance of the system overall.

Operating in association with each chiller 52 is an associated condenser 86. The condenser 86 receives and disseminates water to and from a tower, not shown, through feed and return lines 88, 90 the force being provided by a condenser pump 95. A compressor 84 thermally couples the chiller and condenser. Pressure transfer lines 96, 96*a* from the input and output of the condenser 86 feed a flow indicating switch 98*a*. A condenser valve 102, in the nature of that in the water bridge, is coupled between the tower and the condenser for monitoring and controlling the temperature or flow of the water through the condenser. A pressure transmitter controller 104 is located between the condenser and flow controller to sense the pressure in the condenser and to feed its output to the flow controller for control of the condenser valve.

The foregoing sets forth the elements by which the process water of the system is chilled, monitored, and controlled for providing water to the transport primary loop 20 for use by the secondary loop 40. The chiller subassembly 14 has several signal outputs to the various control panels as will be later described.

Air Cooling Subassembly

A typical air cooling subassembly is based upon a secondary loop as shown in FIG. 1A. It includes a water bridge 12 having connections 108 and 110, FIG. 2, tapped into the feed and return lines 22, 24 of the primary transport loop 20 and connections 112, 114 tapped into the feed and output lines 36, 38 of the secondary loop 40. The secondary loop 40 includes a secondary cooling coil pump 116 and, intermediate their ends, cooling coils 120 located in an air duct 118. Within the duct, a return exhaust fan 122 and a supply air fan 124 move air to be conditioned by fluid, preferably chilled water, in the coils 120 of the secondary loop 40. A sensor 126 is located in the flow of conditioned air for effectively determining the temperature of the air downstream of the coils. In the alternative, the secondary loop temperature is monitored by sensors 128 and/or 130 in the secondary loop feed and/or return lines 36, 38. A recirculating damper 134 and exhaust damper 136 are utilized in the ducting for air flow control.

All of the operating parameters, including kilowatt usage of the various motors, as well as the various temperatures and pressures are monitored through a control panel for the fan unit in the secondary loop. The controller assembly for each secondary loop unit also has adjustment mechanism for controlling the operations of the operating characteristics of the elements associated with the secondary loop. The output of each secondary loop controller assembly, like the output of the primary loop flow controller 80, are fed into the system analyzer for monitoring and controlling the entire system. The signals associated with the airflow subassembly include (a) a feedback line 142 to the temperature valve 144 and pressure valve 146 of the water bridge 12, (b) a line 148 for power to, and a reading from the supply air fan 124, (c) a reading of a static pressure sensor 152, (d) a line 154 for the motor 156 for the damper 158 on the air outlet side of the duct, (e) a line 162 for reading from the leaving air flow temperature, (f) a line 166 reading of the air temperature, (g) a line 170 to a sensor 128 for a reading of the entering water temperature of the coils, (h) a line 172 to a sensor 130 for a reading of the temperature of the leaving water of the coils, (i) a line 172 for reading of the air input temperature by sensor 176, (j) a line 178 for power to, and a reading from, the return air flow fan 122, (k) a line 180 with power to, reading of and control of the damper motor 182, and (l) line 184 for readings of the air flow input and output.

The various motors for the air supply and ducting are coupled through a common control package, not shown, for correlating the power thereof in the conventional manner.

Water Bridge

The bridge 12 for fluid, preferably water, is a device positionable to couple the feed and return lines of the primary transport loop 20 with the input return lines of the secondary loop 40. A common crossover line 190 couples these two loops. Primary pump 26 feeds the process water through the primary transport loop. A secondary pump 116 feeds the process fluid through the secondary loop as needed. In those conditions when it is not desired for the secondary loop to function for its air cooling purposes, the secondary pump is inactivated. This closes the crossover line 190. Because cooling is shut down, valve 146 senses the demand for cooling and closes. This response stops unnecessary bypass flow through the secondary loop when not required. The constantly operating pump of the primary loop feeds small quantities of process fluid through a supplemental line 194, passing a sensor 192, from supply to return with no bypass through the secondary loop or crossover conduit 190. When, however, it is desired to utilize the secondary loop for its cooling function, the secondary pump 116 is activated so that a flow of process fluid is created to the secondary loop. The first or pressure responsive valve 146 (V-1) is located in the water bridge adjacent the return line of the primary loop. This pressure valve is available to control the total flow of fluid through the primary loop to meet the demand needs of the secondary loop.

The pressure valve 146 is opened or closed to any extent as a function of the pressure drop across the crossover line 190. This is effected through a sensor 192 coupled with respect to the crossover line preferably in association with an additional smaller supplemental line 194 coupling the ends of the crossover line in parallel therewith to effect a significantly lesser, but proportional, flow and pressure through the supplemental line 194 as compared with the larger flow through the crossover line 196. The detected pressure correlates directly to the fluid flow across the cross-over line which, through the controls located at the supplemental line, open or close the pressure valve proportionately for effecting the proper fluid flow through the primary loop.

A second or temperature responsive valve 144 (V-2) is located intermediate the ends of the supplemental crossover lines. Like the first valve, the second valve is variable to proportionately restrict the flow of fluid, but through the crossover line. This valve is controlled through the controller with its temperature sensor located at any one of a plurality of predetermined points such as in the airflow at the output of the cooling tubes 120, at the input to the secondary loop shown as sensor 128, or at the output of the secondary loop shown as sensor 130. So long as the temperature is within a predetermined range, the valve will not vary. Once, however, its sensor detects a change from the desired temperature, this information is fed to the controller for increasing or opening or closing the temperature responsive valve appropriately.

In operation and use, when a secondary loop 40 requires little or no cooling power from the processing fluid, such pressure will be noticed through the flow sensor and the pressure valve 146 will close an appropriate amount to restrict the flow of the process fluid through the primary loop 20 and thereby minimize power usage on the pumps and on the chillers. When, however, usage by the secondary loops 40 is increased, additional processing fluid and chilling will be required. This information will be fed back and the pressure valve will open an appropriate amount as determined through the controller.

In a correlated manner, when the temperature of the process water of the secondary loop becomes excessively cool, or the process water in the secondary loop 40 becomes acceptably cool, the temperature valve 144 will open appropriately to restrict its use and also signal the decoupler assembly 30 to recirculate and use less chilled process water. Conversely, if the air or other sensor temperature becomes too warm, the temperature valve will close and the chilled process water will flow in greater quantities to effect the desired increased chilling.

Water Bridge Controls

In the prior art water bridges, the sensors for temperature and pressure were appropriately located in the area where sensing was to occur. The controller for the temperature sensor was located at the temperature sensor while the controller for the pressure sensor was located adjacent to its associated valve. The controller, one for each water bridge, was set and controlled independent of associated controllers.

In accordance with the present invention, the controller for each water bridge 12 is a common controller unit 140 located at the crossover line 190. The controller of the water bridge is coupled to its remote sensors but with the pressure sensor built integral with its controller. The individual controllers for the individual water bridges are then coupled to a common host computer 50 which, unlike the prior art devices, allows for feed back control information to the individual controllers in communication fashion. The host computer then, in effect, controls the pressure and temperature valves of all the water bridges of all the secondary loops in an integrated systems manner.

Figure 4:
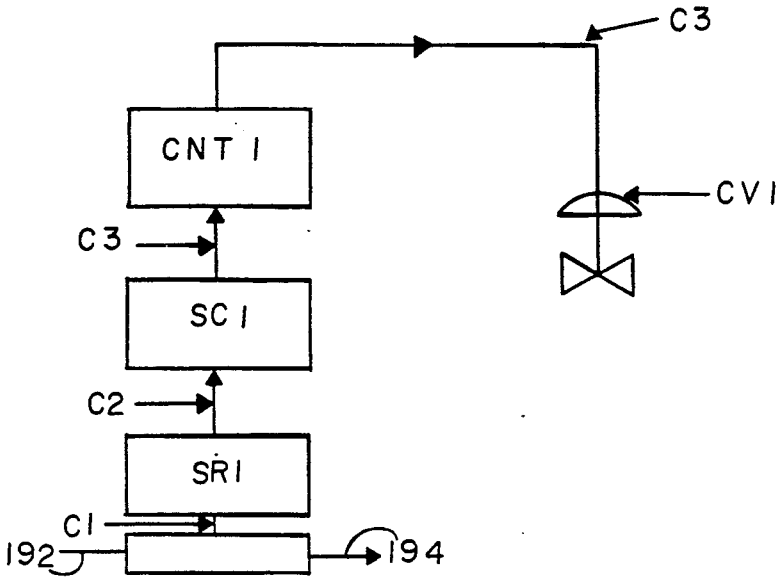
FIG. 4 is a schematic representation of one flow sensor feeding its controller.

In FIG. 4, the sensor 192, provides an electronic output relative to fluid flowing through the supplemental line 194 to the sensor 192 to sensor signal receiver SR 1 through transfer cable C1. The sensor output is fed directly to a dedicated signal converter SC1 by means of transfer cable C2. The signal converter SC1 provides a signal output to a dedicated water bridge controller CNT1. This signal is transferred between the signal converter and the controller by means of transfer cable C2. The signal converter is also capable of variable time damping of its output to cable C2. This allows for better system control tuning. Controller CNT1 generates a control output along cable C3. The control output has three modes of control, proportional, integral, and derivative which provides a control signal to a control pressure valve CV1. The sensor signal on C1, the signal converter output on C2, and the controller output on C3, can be pneumatic but preferably electrical such as current, but most preferably a voltage. The three main components, the sensor SE1, the signal converter SC1, and the controller CNT 1, along with their transfer signals along C1 and C2 are integrated into a single packaged unit. C3 is the controller output function for the integrated prepackaged control unit.

The flow sensor SE1 in FIG. 4 is accomplished by one of the following methods: thermal dispersion, magnetic induction, differential pressure, element strain gauge, vortex shedding or turbine. Thermal dispersion is preferred. The flow sensor SE1 and its associated signal converter SC1 are an integral part of the controller CNT1 as shown in FIG. 1.

Figure 5:
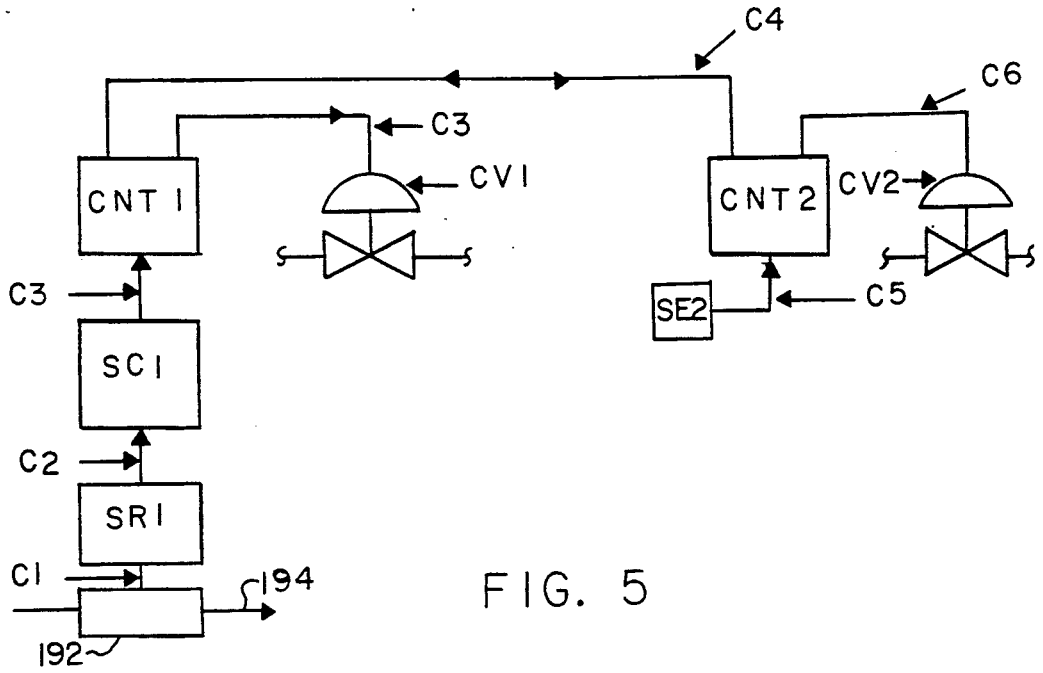
FIG. 5 is a schematic representation of one flow sensor feeding its controller, one temperature sensor feeding its controller and the cross communication between controllers.

FIG. 5 shows two water bridge controllers and their interaction with one another. Controller CNT1 is primarily used to control the process water flow to the secondary loops as described in two aforementioned patents. Controller CNT2 controls the process water temperature as described in the aforementioned '995 patent. Controller CNT2 is fed through a transfer cable C5 by a temperature sensor SE2.

A transfer cable C4 connects the pressure and temperature controllers CNT1 and CNT2. This interconnect allows each controller to talk to the other. In this way, CNT1 can reset the set point of CNT2. Likewise CNT2 can reset the set point of CNT1. CNT1 can also define all other operating parameters for CNT1 including limits. The output communication between CNT1 and CNT2 includes, but is not limited to process variable, control signal output, deviation from set point, set point and PID setting. A prime reason for this communication is to prevent unnecessary control oscillation or hunting.

Figure 6:
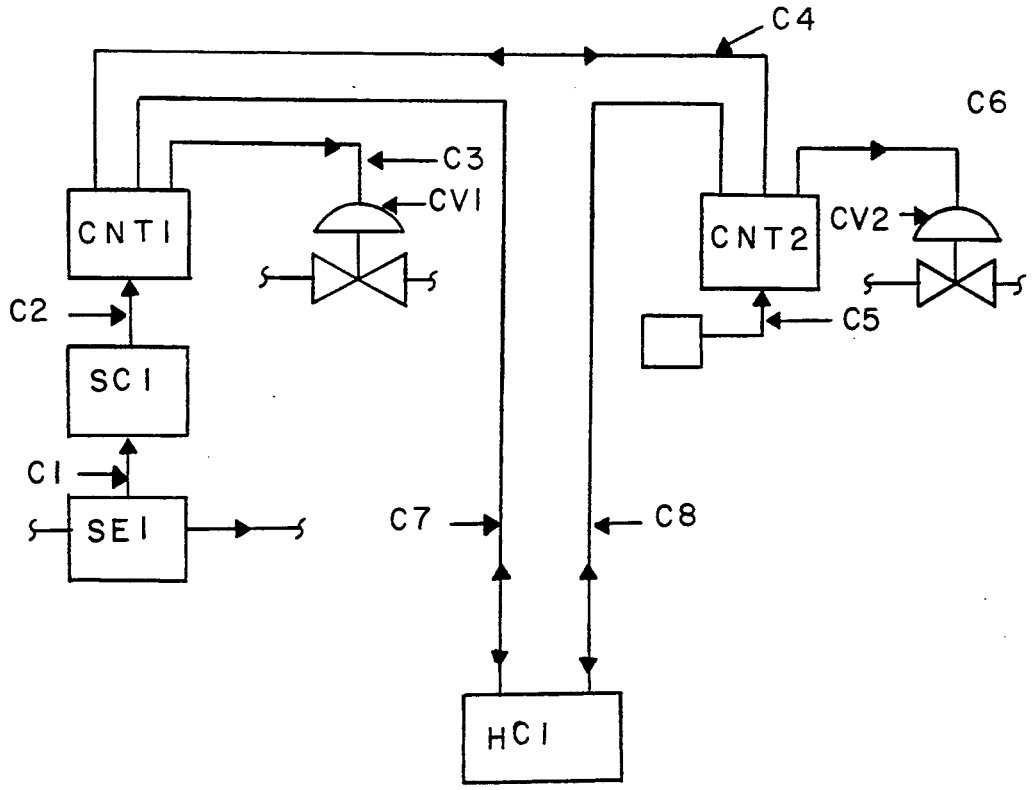

FIG. 6 shows the two controllers, CNT1 and CNT2, as described above. Also shown in FIG. 6, however, is a host computer/data gathering system HC1. There is two way communication between the controller CNT1 and the host computer HC1 via a transfer cable C7. There is likewise a two way communication between the controller CNT2 and the host computer HC1 via transfer cable C8. HC1 is capable of resetting the set points of CNT1 and CNT2 through their associated transfer cable C7 and C8. HC1 receives but is not limited to the following information from CNT1 and CNT2: process variable, control signal output, deviation from set point; set point and PID settings. The host computer can use the data for resetting controller set point, setting limits, system management, trending, and historical data accumulation.

Figure 7:
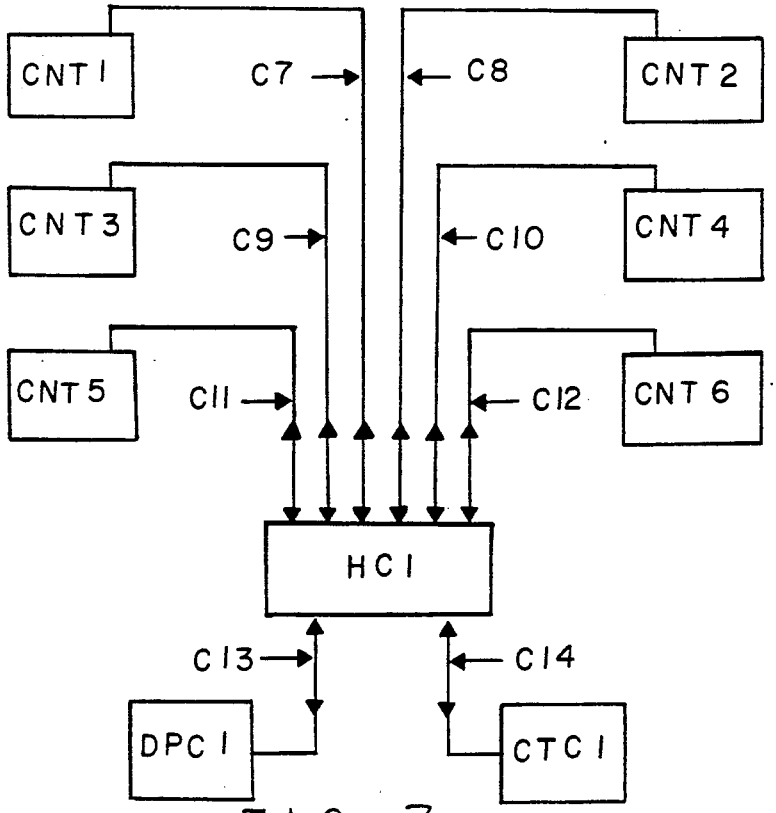
FIG. 7 is a schematic representation similar to FIG. 6 but illustrating a plurality of water bridge controllers interfacing with the common host computer as well as the controlling mechanisms.

FIG. 7 shows a two way communication system between a host computer/data gathering system HC1 and a number of controllers previously described hereinabove with regard to FIGS. 5 and 6 and marked as CNT1 through CNT6 by way of transfer cables C7 through C12.

FIG. 7 also shows HC1 connected to a system differential pressure controller DPC1, via a two way transfer cable C13. In this case controllers CNT3 and CNT5 provide the same control function as controller, CNT1, as described with respect to FIG. 4. The host computer HC1 received inputs from the controllers CNT1, CNT3, and CNT5 and computes the required differential requirements for optimum operation of the system. The differential pressure controller DPC1 is then automatically adjusted to meet the computed requirement as defined by HC1. The two way communication between the host computer HC1 and the system differential pressure controller DPC1 include but are not limited to reading and resetting of process variable, control signal output, deviation from set point, set point, and PID settings.

FIGS. 1A and 7 also show a host computer HC1 connected to a central system output temperature controller CTC1 via a two way transfer cable C14. In this case controllers CNT4 and CNT6 provide the same control function as controller CNT2 as described with respect to FIG. 5. The host computer HC1 receives inputs from the controllers CNT2, CNT4, and computes the required central operating processing water temperature for optimum operation of the system. The central system output temperature controller CTC1 is then adjusted to meet the computer requirements as defined by HC1. The two way communication between the host computer HC1 and the central system output temperature controller CTC1 include but is not limited to reading and resetting of process variable, control signal output, deviation from set point, set point, and PID setting.

Monitoring and Control Panels

Shown in FIGS. 1 and 1A are five control panels working in systems configuration for monitoring and controlling the entire flow control system. They include the airflow control panel coupled with respect to the air cooling subsystem, the decoupler panel coupled with respect to the decoupler assembly between the water chiler subassembly and the air cooling subassembly, the chiller analyzer panel coupled with respect to the water chiller subassembly, the main system analyzer coupled with respect to the other control panels, and the host computer for coupling all of the water bridge controllers.

The air flow control panel includes dials for indicating the air supply AS in cubic feet per minute, the exhaust/recirculating airflow ER in cubic feet per minutes, and the static pressure SP to the air system for the air supply. These last two dials include manual adjustment mechanisms under the control of an operator. The other six indicator blocks are for measuring and indicating the power usage in kilowatts of the airflow AF, the entering water temperature EWT, the leaving water temperature LWT, the leaving air temperature LAT (which may be reset manually), the entering air temperature EAT and the gallon per minute water usage GPM to the secondary loop.

Lastly, an adjustable two-way sensor LAC for the water bridge control valve is utilized. In addition to the inputs through the air flow control panel from the secondary loop components, the adjustment mechanisms of the air flow control panel feedback input to the secondary loop elements. Further, the readings of the various components of the air flow control panel are fed to the main system analyzer for monitoring the power usage and other variables of the system from all of the secondary loops.

The decoupler panel includes readouts for the refrigeration loop water usage RLS in gallons per minute and primary chilled water transfer loop PCW line water usage in gallons per minute. Also, there is the primary chilled water supply temperature PCWS. These items are adjustable to feed back to the decoupler panel and may operate in an outomatic or manual mode. Other readouts are the entering and leaving water temperature RLRT and PRT and in gallons per minute as well as the entering and leaving water pressures RLST and PST. The output of the decoupler panel is fed back to the decoupler through the adjustment mechanisms as described above. The usage in terms of power and temperature is also fed to the main system analyzer along with the read temperature and pressure.

The decoupler panel also functions to monitor and control the water chiller subassembly which has three adjustment features with associated readouts. These are for the water flow therethrough GPM in gallons per minute, the temperature of the leaving water LWT, and the condenser pressure COND for the water controller valve. Further readouts are for the entering water temperature ECWT, leaving water temperature LCWT and power usage. On/off switches are provided along with a light to indicate a malfunction and the need for operator assistance. In addition to the adjustment features feeding back to the water chiller subassembly, the output of the water chiller analyzer panel is also fed to the main system analyzer for integrating these readings.

The main system analyzer receives its input from the decoupler panel, chiller analyzer panel and the air flow control panel. It has two adjustable readouts, for the water leaving temperature PCWLS and for the leaving air temperature LAT. The outputs from these variable control features are fed back to the water chiller subassembly for control purposes. The rest of the components of the main system analyzer are for receiving and assembling the outputs of the various other panels of the system. These additional readouts are for total air flow CFM in cubic feet per minute and associated power usage in kilowatts KW, total system TS kilowatts KW, cooling water and air temperature, air flow power usage in kilowatts. Associated with the main system analyzer is an off/on with start/stop features for the system and lights to indicate operation of the fan, chiller and pump along with an indication of temperature. A keyboard is provided to monitor and modify the readings through modifying the system which provides the readings.

The last component of the system is the host computer showing FIG. 1A operatively coupled with the water bridge of the secondary loop with lines for coupling with other similar water bridges of the other water loops.

The present invention is described with respect to controlling the pressure and temperature of chilled water for use in cooling an air flow. It should be realized, however, that the present invention could be utilized for controlling the flow of other fluids, with the controlling being in response to other properties of the controlled fluid, and with the fluid being used for cooling, heating, or other functions.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and combination and arrangement of parts may be resorted to without departing from the spirit and scope of the invention.

Now that the invention has been described,

What is claimed is:

1. Apparatus for coupling a primary loop with a secondary loop for circulating processing fluids therebetween comprising in combination:

a first connection for the feed line of the primary loop and a second connection for the return line of the primary loop;

a third connection for the feed line of the secondary loop and a fourth connection for the return of the secondary loop;

a crossover line coupling the four connections;

first valve means in the path of flow through the primary loop;

first sensor means located in the flow across the crossover line to control the first valve means to vary the flow therethrough;

second valve means located in the path of flow through the crossover line;

second sensor means responsive to the temperature associated with the secondary loop to control the second valve means by blending flows from the primary and secondary loops through the second valve means;

a common controller for the first and second sensor means adapted to control the first and second valve means as a function of the sensed temperature and flow; and a host computer coupled to the common controller and couplable with other similar common controllers for two-way communications between the common controllers and host computer in systems configuration.

2. The apparatus as set forth in claim 1 wherein the second sensor means is located in the output path of flow of fluid moving past the secondary loop.

3. The apparatus as set forth in claim 1 wherein the second sensor means is located adjacent to the third orifice.

4. The apparatus as set forth in claim 1 wherein the second sensor means is located adjacent to the fourth orifice.

5. The apparatus as set forth in claim 1 and further including a supplemental line fluidically coupled in parallel with the crossover line and of a smaller diameter than the crossover line.

6. The apparatus as set forth in claim 5 wherein the common controller is located adjacent to the secondary line.

7. The apparatus as set forth in claim 6 wherein the first sensor means is located in the supplemental line.

8. The apparatus as set forth in claim 7 wherein the first sensor means is integrated with the common controller.

9. A system for controlling the flow of process fluids comprising:

a primary loop for process fluids;

a plurality of secondary loops for process fluids;

a plurality of bridges, each coupling the primary loop with a secondary loop, each bridge having feed and return connections coupled to the feed and return lines of the primary loop and feed and return connections coupled feed and return lines of a secondary loop and a crossover line coupling the primary and secondary loops;

a pressure responsive valve located in the path of flow through the primary loop and a flow sensor for each bridge to determine the flow in its crossover line for controlling the pressure responsive valve, to thereby vary the flow of fluid through each bridge;

a temperature responsive valve in the crossover line for each bridge and a temperature responsive sensor responsive to the temperature at the secondary loop for controlling the recirculation of fluid from the secondary loop through the temperature responsive valve;

a common controller for each bridge adapted to modify its valves as a function of the sensed temperature and flow; and a host computer coupling the common controllers in systems configuration for controlling the common controllers.

10. The system as set forth in claim 9 wherein the host computer is in two way communication with all of the common controllers.

11. The system as set forth in claim 9 wherein each common controller has a controller component for its pressure sensor and a controller component for its temperature sensor.

12. The system as set forth in claim 9 wherein the set points for each individual common controller and bridge may be controlled at the common computer.

13. A system for cooling a flow of air at a plurality of sites comprising:

a process fluid chiller subassembly;

a plurality of air cooling subassemblies;

a primary loop for process water extending between the process fluid subassembly and the plurality of air cooling subassemblies;

means to effect a flow of air to be cooled across the secondary loops at the sites to be cooled;

a plurality of fluid bridges, each coupling the primary loop with a secondary loop, each fluid bridge having feed and return orifices coupled to the feed and return lines of the primary loop and feed and return connections coupling feed and return lines of a secondary loop, and a crossover line coupling the primary and secondary loops;

a pressure responsive valve located in the path of flow through the primary loop and a flow sensor for each fluid bridge to determine the flow in its crossover line for controlling the pressure responsive valve to thereby establish the flow therethrough;

a temperature responsive valve located in the crossover line for each fluid bridge and a temperature responsive sensor responsive to the temperature of the process fluid in the secondary loop for blending fluids from the primary and secondary loops;

a common controller for each fluid bridge adapted to modify its valves as a function of the sensed temperature and pressure; and a host computer coupling the common controllers in systems configuration for controlling the common controllers.

14. A method of cooling a flow of air at a plurality of sites comprising the steps of:

providing a process water chiller subassembly;

providing a plurality of air cooling subassemblies;

feeding a flow of process water in a primary loop extending between the process water subassembly and the plurality of air cooling subassemblies;

effecting a flow of air to be cooled across the secondary loops at the sites to be cooled;

providing a plurality of water bridges, each coupling the primary loop with a secondary loop, each water bridge having feed and return connections coupled to the feed and return lines of the primary loop and feed and return connections coupling feed and return lines of a secondary loop, and a crossover line coupling the primary and secondary loops;

sensing the flow in each waterbridge crossover line;

varying a valve in the path of flow through the primary loop in response to the sensed flow to merely modify the primary flow available to the secondary loop;

sensing the temperature of the process water in the secondary loop;

varying a temperature responsive valve in the crossover line in response to the sensed temperature;

providing a common controller for each water bridge adapted to modify its valves as a function of the senses temperature and pressure; and coupling the common controllers with a host computer in systems configuration for controlling the common controllers and the system.

* * * * *